US005855631A

United States Patent [19]

Leas

[11] Patent Number: 5,855,631

[45] **Date of Patent: *Jan. 5, 1999**

[54] CATALYTIC GASIFICATION PROCESS AND SYSTEM

[76] Inventor: Arnold M. Leas, 122 N. 34th St., 10-C, Richmond, Ind. 47374

[ * ] Notice: The term of this patent shall not extend beyond the expiration date of Pat. No. 5,641,327.

[21] Appl. No.: 851,816

[22] Filed: May 6, 1997

Related U.S. Application Data

[60] Continuation-in-part of Ser. No. 716,716, Sep. 13, 1996, Pat. No. 5,776,212, which is a division of Ser. No. 352,833, Dec. 2, 1994, Pat. No. 5,641,327.

[51] Int. Cl.[6] ..... C10J 1/28; C10J 3/72

[52] U.S. Cl. ..... 48/197 R; 48/63; 48/73; 48/77; 48/99; 48/202; 48/203; 48/210

[58] Field of Search ..... 48/73, 77, 63, 48/99, 189.1, 198.2, 198.3, 202, 203, 210, 197 R; 422/191, 192, 193

[56] References Cited

U.S. PATENT DOCUMENTS

| | | | |
|---|---|---|---|
| 2,582,711 | 1/1952 | Nelson | 48/77 |
| 3,322,521 | 5/1967 | Cockerham | 48/76 |
| 3,689,240 | 9/1972 | Aldridge | 48/202 |
| 3,847,563 | 11/1974 | Archer et al. | 48/77 |
| 3,985,519 | 10/1976 | Kalina et al. | 48/202 |
| 4,274,839 | 6/1981 | Leas | 48/202 |
| 4,280,893 | 7/1981 | Leas | 208/10 |
| 4,410,420 | 10/1983 | Liss et al. | 208/127 |
| 4,555,249 | 11/1985 | Leas | 48/62 R |
| 4,725,288 | 2/1988 | Bougard | 48/76 |
| 5,346,515 | 9/1994 | Kubiak et al. | 48/73 |

*Primary Examiner*—Nina Bhat
*Attorney, Agent, or Firm*—Bradford E. Kile; Karan Singh

[57] ABSTRACT

A catalytic gasification process and system for producing medium grade BTU gas including a gasification reactor having an inner air gasification zone, an outer steam gasification zone, a synthetic coal reaction zone, and an upper lime treating zone. The process and system of the present invention further includes a synthetic coal heating vessel which provides superheated recycled synthetic coal to the gasification reactor and a limestone treating vessel which provides superheated air and $CO_2$ to the gasification reactor. The novel process and system of the present invention provides for the production of a medium grade BTU gas and several commercially valuable by-products with virtually no solid or liquid waste products.

30 Claims, 7 Drawing Sheets

MEDIUM BTU GAS 84
CaS 70
LIME 72
LIMESTONE 74
SYN-COAL 62
N2 & CO2 65
LIMESTONE 74
SYN-COAL 62
ASH 98
LIME 72
AIR 64
HEAT
HOT AIR + CO2 34
STEAM 50
CO2 60
SYN-COAL 42
SYN-COAL 26
REC. REAG. 104
HEAVY METALS 100

MEDIUM BTU GAS 84
CaS 70
LIME 72
LIMESTONE 74
SYN-COAL 62
N2 & CO2 65
LIMESTONE 74
SYN-COAL 62
ASH 98
LIME 72
AIR 64
HEAT
HOT AIR + CO2 34
CO2 60
SYN-COAL 42
SYN-COAL 26
REC. REAG. 104
POWDER IRON CARBIDE 415
400
13
15
12
14
16
16
18
403
405
407
409
411
413
417
20
22
24
28
30
36
38
40
44
46
48
54
56
58
63
66
68
76
78
80
82
86
88
90
92
94
96
106
19
A
B

MEDIUM BTU GAS 84
CaS 70
H2 & CO 302
LIME 72
LIMESTONE 74
SYN-COAL 62
N2 & CO2 65
LIMESTONE 74
SYN-COAL 62
ASH 98
LIME 72
AIR 64
HEAT
HOT AIR + CO2 34
HOT 32
SYN-COAL 42
CO2 60
STEAM 50
SYN-COAL 26
REC. REAG. 104
REDUCED IRON 505

CATALYTIC GASIFICATION PROCESS AND SYSTEM

This application is a continuation-in-part of U.S. patent application Ser. No. 08/716,716, filed Nov. 22, 1996, now U.S. Pat. No. 5,776,212, which is a division of U.S. patent application Ser. No. 08/352,833, filed Dec. 2, 1994, now U.S. Pat. No. 5,641,327.

BACKGROUND OF THE INVENTION

The present invention relates to an improved process and apparatus for producing a useful gas from carbonaceous fuels. Specifically, the invention relates to a novel process and apparatus for producing a medium grade BTU clean gas from carbon-based fuels, such as coal, petroleum coke and residual petroleum fuels, without the use of manufactured oxygen. Moreover, the novel process and apparatus provides for the production of other products, such as iron carbide, iron, and dry gas, having direct commercial utility with virtually no solid or liquid waste.

Coal is the world's most abundant fuel resource. However, coal has not been suitable in many commercial applications as an energy source due to its practical limitations such as difficulties of transport and incompatibility with power generating devices.

Coal gasification processes have been developed which attempt to transform the coal from a carbonaceous solid fuel to a gas fuel which has much more practical utility. Such a system, for example, was disclosed in my U.S. Pat. No. 4,555,249 for "Process for Gasification of Coal and Organic Solid Wastes" and U.S. Pat. No. 4,274,839 for "Process for Gasification of Coal and Organic Wastes" the disclosures of which are hereby incorporated by reference. Generally, gasification processes provide a means for converting combustible organic materials such as coal, residual petroleum, wood, tar sand, shale oil, and municipal, agriculture or industrial waste into a gas end product typically consisting of hydrogen or methane gas. The gas end product is then commonly utilized in a downstream phase of the process. For example, the gas product may be used to produce steam for the production of electricity or heating by passing the hot gases through a steam generation zone. Moreover, the production gases are often utilized in a downstream chemical process for further production. If the gas which is produced is a high grade gaseous stream it may be recovered for direct commercial use as a fuel energy source.

In order to produce a gaseous end product which has direct commercial utility—for example to drive a gas turbine or as a clean compression fuel source for use in an automobile engine—the gas end product must have a useful BTU level or grade. In this, a clean high BTU grade gas (viz., approximately 300 BTU per cubic foot (hereinafter "BTU/C.F.")) is most preferable. However, a clean medium BTU grade gas (viz., approximately 200–275 BTU/C.F.) is also sufficient as an energy source for direct commercial uses. Significantly, however, a low BTU gas (viz., approximately 125–175 BTU/C.F.) is not a useful gaseous product in direct commercial applications. Moreover, a gas product of any grade is not acceptable if it contains contaminates which adversely affect its combustion properties. For example, a gas end product which contains large amounts of carbon dioxide, nitrogen, and sulfur compounds such as hydrogen sulfide ("sulfur gas") cannot be used as a direct energy source for commercial applications. A gas end product having large amounts of contaminates is not acceptable in direct commercial applications, for example in gas turbines, because it will produce flame-out and stoppage. Moreover, the combustion by-products of a contaminated gas will produce environmentally unsafe by-products (e.g., $So_x$ gas, $No_x$ gas, particulate, etc.) which are unacceptable in commercial applications.

Common to all gasification techniques is the need for in process oxygen to carry out the necessary reactions (viz., to react with the carbon of the carbonaceous solid fuel). As a general matter, if the source of in-process oxygen for the gasification process is derived from manufactured oxygen, then the gaseous end product will be a high grade BTU gas. Conversely, if the source of in-process oxygen for the gasification process is derived from air or steam, then the gaseous end product will be a low grade BTU gas. For example, certain gasification processes currently employed by Texaco, Dow, and Shell require a high amount of in-process oxygen in order to produce a useful BTU gas end product. Although the gas end products of the Texaco, Dow, and Shell processes are high grade BTU gases (viz., approximately 300 BTU/C.F.), the processes require the use of manufactured oxygen. A gasification process currently employed by British Gas uses air and steam as a source of in-process oxygen, but the gas end product is a low grade BTU gas having limited commercial utility. The problem with utilizing manufactured oxygen as the source of in-process oxygen is that it has a commercially prohibitive cost. Manufactured oxygen can be one of the most significant costs in a gasification process. Manufactured oxygen is typically produced through a cryogenic method wherein a volume of air is reduced to extremely low temperatures—in the order of 360° F. below zero—whereby the $O_2$ is liquidized and removed in a pure liquid form. Current market rates for manufactured oxygen are approximately from five times the cost of on-site coal. Moreover, an oxygen gasification process requires about one ton of oxygen for every ton of coal. Accordingly, the high cost of manufactured oxygen adversely affects the economic efficiency of a gasification process. A common denominator of all gasification systems is that they must be economical to operate. Gasification systems have large initial capital investment cost and as a result, a low process efficiency is unacceptable to gasification management teams. In this, coal deposit owners are discouraged from using gasification techniques which are capable of producing a high BTU gas for direct commercial applications—for example to drive a gas turbine or as a clean compression fuel source for use in an automobile engine—which prevents the expansion of use of clean energy sources by the public. For example, a ready and cost effective source of compressed hydrogen would encourage automobile manufacturers to develop some hydrogen fueled automobiles. As noted, in order to effectively operate gas turbines, a medium to high grade BTU gas is required. Electrical power producers are discouraged by the high cost of coal gasification and have in the past almost exclusively utilized natural gas sources.

Manufactured oxygen has been the preferable source of process oxygen because it not only provides the necessary reaction content for the creation of a high grade BTU gas, but an excess amount of non-reacted $O_2$ is burned in order to create additional and necessary process heat. In order to eliminate the need for manufactured oxygen attempts have been made to use a process catalyst which accelerates the process reactions in order to provide beneficial temperature affects. One such attempt has been made by Exxon Research and Engineering Co. wherein the process reactions are carried out in the presence of a carbon-alkali metal catalyst. However, this Exxon gasification process and reaction catalyst have proven ineffective and problematic. The carbon-alkali metal catalyst of the prior art consist of an alkali metal (e.g., Na) with impregnated carbon. The alkali and carbon, however, are not chemically bonded, but merely coexist in their respective forms. Typically, the catalyst, in liquid form, is sprayed onto a fine coal and delivered to a reaction vessel. The inherent problem with the prior art catalyst is that once the gasification reactions are complete, the catalyst must be separated from the reaction products, such as coal, for disposal and/or recycling. This separation step involves the use of complex reactor designs and additional hardware which not only increase the complexity of the system, but increase capital cost significantly. As such, the prior art gasification systems which utilize reaction catalysts have proven to be commercially unacceptable. The prior art gasification systems have failed to provide a recycle reagent which serve as a process catalyst while providing superior recycling and density properties.

Prior art gasification methods and systems have proven disadvantageous for several other significant reasons. First, the prior art thermal gasification systems and methods require very high operating temperatures—approximately 2500° to 2800° F.—in order for the process reactions to occur. At these extreme operating temperatures, the iron based reaction vessels will melt if cooling mechanisms are not in place. Typically, such mechanism include complex and expensive vessel insulation schemes and/or heat exchanger cooling. Moreover, the high reaction temperatures require the use of expensive iron alloys—such as 310 Cr/Ni stainless steel as fabrication material for the reaction vessels.

The prior art methods and systems have relatively low thermal process efficiencies. The prior art methods and systems have been unable to maximize the extent of gasification which occurs during the process thereby obtaining relatively low conversion efficiencies. The prior art methods and systems produce environmentally unsafe by-product waste which requires costly post process handling. The prior art techniques have been unable to produce commercially useful by-products from the gasification process. The prior art gasification methods and systems require the manufacturing of special process modules and hardware which increase production cost and make it more difficult to relocate from one mine site to another as resources change. The prior art systems which utilize manufactured oxygen in the production of high grade BTU gas, produce a product gas having very high exit temperatures which cannot be directly used in gas turbines.

The difficulties and limitations suggested in the preceding are not intended to be exhaustive, but rather are among many which demonstrate that although significant attention has been devoted to solid gasification methods and systems, such methods and systems appearing in the past will admit to worthwhile improvement.

OBJECTS AND BRIEF SUMMARY OF THE INVENTION

It is therefore a general object of the invention to provide a novel gasification process and system which will obviate or minimize difficulties of the type previously described.

It is another general object of the invention to provide a novel gasification process and system which provides for the production of a medium grade BTU gas (i.e., approximately 225 BTU per cubic foot) without manufactured oxygen.

It is another general object of the invention to provide a novel gasification process and system which provides for the production of a gas end product having direct commercial use—for example to drive a gas turbine or as a clean compression fuel source for use in an automobile engine—without the need for further downstream processing.

It is another general object of the invention to provide a novel gasification process and system which utilize coal feed, petroleum coke, residual petroleum fuels, among others, for the production of a medium grade BTU gas without use of manufactured oxygen.

It is another general object of the invention to provide a novel gasification process and system which provides for the production of other end products having direct commercial use such as iron carbide, iron and dry gas.

It is another general object of the invention to provide a novel process and system which provides for the preparation and purification of a novel catalytic process reagent.

It is a specific object of the invention to provide a gasification process and system which utilizes a catalytic process reagent which optimizes process parameters.

It is another specific object of the invention to provide a gasification process and system which utilizes a catalytic reagent which does not require post reaction separation steps.

It is yet another specific object of the invention to provide a gasification process and system which utilizes a catalytic process reagent having optimal density and recycling characteristics.

It is still another specific object of the invention to provide a gasification process and system which operates under substantially reduced reaction temperatures.

It is yet another specific object of the invention to provide a gasification process and system which substantially increases the fuel-gas conversion efficiency over prior art systems.

It is another specific object of the invention to provide a gasification process and system which substantially decreases production cost over prior art systems.

It is yet another specific object of the invention to provide a gasification process and system which provides for the production of useful and commercially viable end products.

It is still another specific object of the invention to provide a gasification process and system which eliminates and/or significantly reduces the formation of environmentally harmful by-products.

It is yet another specific object of the invention to provide a gasification process and system wherein the primary reactions are contained within a single reaction containment vessel thereby optimizing reaction heat transfer and reducing production cost.

It is still yet another specific object of the invention to provide a gasification process and system which is designed such that removal of useful reaction products is easily accomplished without the need for special separating devices.

It is still yet another specific object of the invention to provide a gasification process and system which includes further downstream operations to produce additional products having direct commercial utility.

It is still yet another specific object of the invention to provide a process and system for the preparation and purification of a novel process catalyst for use in the solid gasification processes and systems of the invention.

BRIEF SUMMARY OF PREFERRED EMBODIMENTS OF THE INVENTION

Preferred embodiments of the invention which are intended to accomplish at least some of the foregoing objects comprise a catalytic gasification process and system including a gasification reactor having an inner air gasification zone, an outer steam gasification zone, a synthetic coal reaction zone, and an upper lime treating zone. The process and system of the present invention utilizes a novel catalytic reagent that serves to optimize reaction parameters and process flow and which does not require post reaction separation steps. The novel process and system of the present invention provides for the production of a medium grade BTU gas and several commercially valuable products with virtually no solid or liquid waste products. A novel process and system is provided for the preparation and purification of the catalytic process reagent.

DRAWINGS

Other objects and advantages of the present invention will become apparent from the following detailed description of preferred embodiments thereof taken in conjunction with the accompanying drawings, wherein.

DETAILED DESCRIPTION

As used herein, conventional terms have their generally accepted meanings. For example, the term "coal ash" refers to ash which is present in coal; the terms "clean ash", "clean coal ash", "synthetic coal" and "syn-coal" refer to coal ash with carbon deposited on the ash and with sulfur, heavy metals and chlorine removed; the term "dry gas" refers to $H_2$ and CO without methane, ethane, propane, etc.; the term "fine coal" means pulverized coal having particle sizes in the range of about 30–300 mesh; the terms "hot air" and "superheated air" refer to air having a temperature in the range of about 1000°–1800° F.; the terms "low, medium and high grade BTU gas" refer to gas having 125–175 BTU/C.F., 200–275 BTU/C.F. and over 300 BTU/C.F., respectively; the terms "process reagent", "catalytic process reagent" and "catalytic reagent" refer to a novel catalytic reagent of the invention; the terms "recycled reagent" and "recycled process reagent" refer to a recycled catalytic process reagent; the term "superheated steam" refers to steam having a temperature in the range of about 300°–1000° F.

Figure 1:
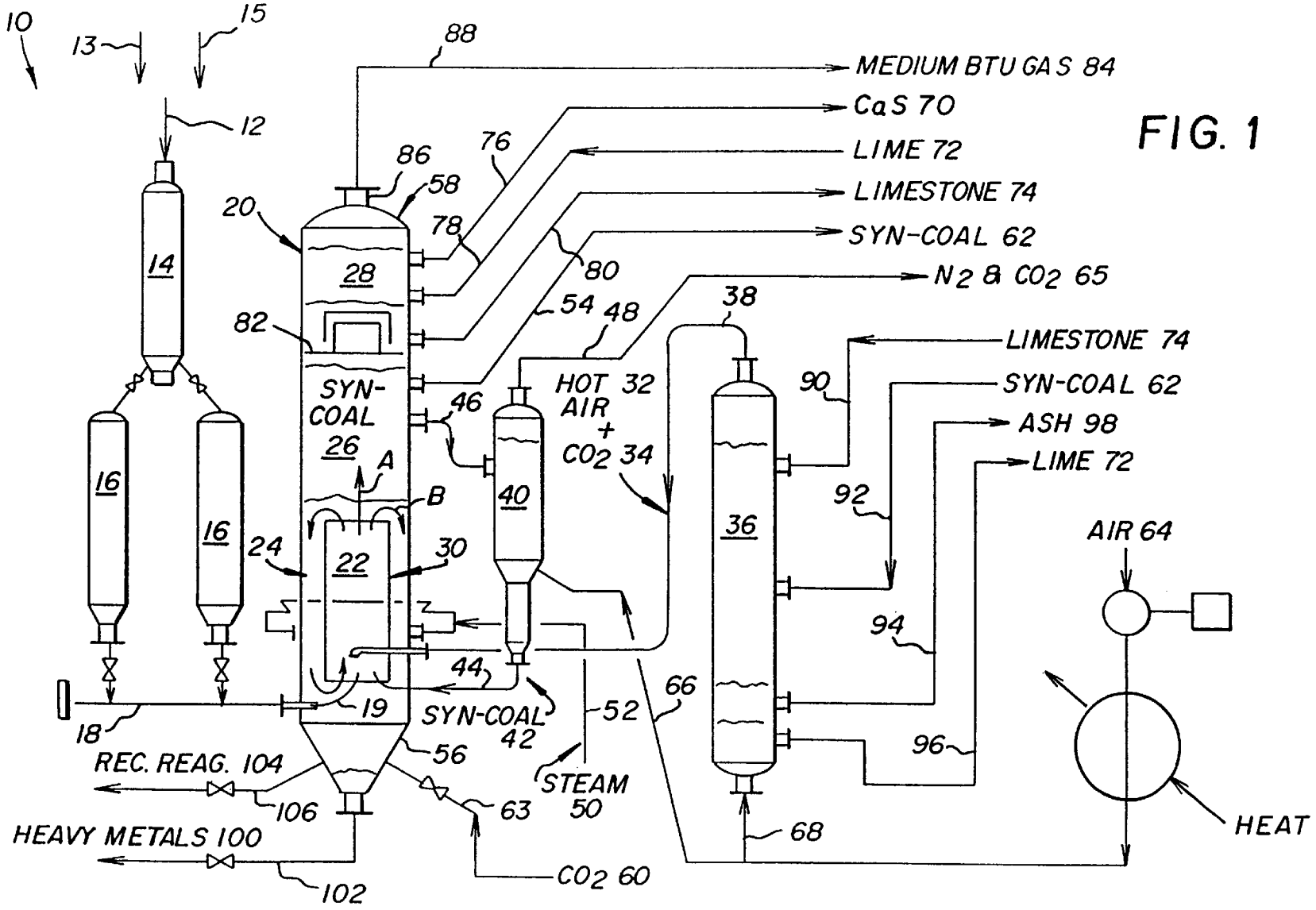
FIG. 1 is a schematic drawing of primary components of the gasification process and system of the present invention.

Referring now to the drawings and particularly to FIG. 1, there is shown primary components of the solid gasification system 10 of the present invention. As shown, the process reactants 12 are conveyed into the elevated surge hopper 14. In the preferred embodiment, the combined process reactants 12 consist primarily of fine coal 13 and a process reagent 15. The blended process reactants 12 have been previously treated in an upstream treatment process not depicted in the drawings. Specifically, raw coal is first delivered from a coal mine and conveyed into a hopper where it is pulverized to form a fine coal product which includes coal ash. Particle size of the fine coal varies depending on the type of coal that is used. The particular particle size of the fine coal is within the skill of a person having ordinary skill in the art. For example, coal having particle size in the range of about 30–300 mesh may be used. The coal used must be a fine coal product which is capable of upward fluidization and downward percolation as described in detail hereinafter. The fine coal product is then conveyed from the hopper into a blender where it is mixed with a process reagent. The particle size of the process reagent is preferably of a size that permits upward fluidization and downward percolation as described in detail hereinafter. The particular particle size of the reagent varies with the source and condition of the process reagent used. The blended fine coal and reagent are delivered as the process reactants 12 to the surge hopper 14 as shown in FIG. 1. The process reactants 12 are then delivered to at least one, but preferably two, lock bins 16. The lock bins 16 serve as a holding vessel for the reactants 12 and assure that a ready supply of reactants 12 is always available for delivery to the gasification vessel 20. Preferably, lock bins 16 are air pressurized vessels which assures sufficient flow of the reactants 12 into the screw drive assembly 18. Vessel pressure is preferably in the order of 180 lbs. per square inch gauge (hereinafter "p.s.i.g.") which assures that the reactants 12 are driven upstream. The surge hopper 14 is located in a position vertically above the lock bins 16 in order to assist in the flow of the reactants 12 as attributed by gravity. The process reactants 12 are delivered from the lock bins 16 into the variable screw drive apparatus 18 which conveys the reactants upon controlled demand into the bottom of the gasification vessel 20. Other conveying devices are considered to be within the scope of the invention.

The gasification vessel 20 is a single shell design and provides significant advantage over prior art vessels. The gasification vessel 20 is designed to contain four process reaction zones 22, 24, 26, and 28 which operate in a related and synergistic fashion to provide the improved and novel results of the present invention. The first inner process reaction zone 22 is located in a beta-leg of the gasification vessel 20. The second outer process reaction zone 24 is located in a gamma-leg of the gasification vessel 20. The third reaction zone 26 is a deep fluidized bed of synthetic coal floating on top of an internal process reagent 15 as more completely described below. A fourth reaction zone 28 is located in a compartment adjoining the third reaction zone 26.

The beta-leg of the gasification vessel 20 is defined by an annular sleeve 30 preferably manufactured from stainless steel. The annular sleeve 30 separates the first inner reaction zone 22 and the second outer reaction zone 24. During the start-up phase of the gasification vessel 20, the vessel is charged with catalytic process reagent 15. The start-up phase of gasification vessels is well known to those skilled in the art and, therefore, will not be discussed in detail here. The catalytic process reagent remains in the vessel 20 during the gasification process and circulates therein. About 2% to 20% of the catalytic process reagent is withdrawn from the gasification vessel 20 for purification, as further discussed in detail below. The purified catalytic process reagent is blended with pulverized coal 13, as previously discussed above. The process reactants 12, consisting of blended pulverized coal 13 and reagent 15, are delivered into the bottom of the betaleg 22 via supply line 19 as shown in FIG. 1. The beta-leg 22 is further supplied with superheated air 32 and hot $CO_2$ 34 delivered from the limestone calcinator 36 via supply line 38 as more fully described below. Heated recycled synthetic coal 42 is delivered from heating vessel 40, via supply line 44, to the beta-leg which houses the inner reaction zone 22. The primary reaction which occurs in the first inner reaction zone 22 is air gasification of the fine coal 13 which occur as follows:

$$2C+AIR\ (O_2)\rightarrow 2CO+N_2+HEAT \quad (1)$$

The superheated air 32 and hot $CO_2$ 34 are supplied from the limestone calcinator 36 under pressure, preferably in the order of 180 p.s.i., which is directed at the fine coal 13. Without being bound by theory, the carbon from the fine coal 13 is oxidized and uniformly redeposited onto the reagent 15, clean coal ash, and recycled syn-coal 42 as the superheated air 32 strikes the incoming dried pulverized coal 13, recycle reagent 15, and recycled syn-coal 42. As indicated, the reaction (1) occurring in the first inner reaction zone 22 is an exothermic reaction which provides the reaction heat necessary for the endothermic chemical reaction (2) occurring in the second outer reaction zone 24. The inner reaction zone forms a fluidized bed of solid and gas moving upward. Samples taken from test runs using a full-scale reactor unit show uniform deposition of carbon from the pulverized coal 13 on the recycled syn-coal 42 which flows upward into the syn-coal fluidized bed 26 as indicated by arrow A. The superheated air 32 also causes the carbon from the pulverized coal 13 to be deposited on coal ash, a product of pulverized coal 13, thereby forming syn-coal which travels upward and into the fluidized bed 26 in the same manner as the recycled syn-coal 42. The superheated air 32 further causes the carbon from the pulverized coal 13 to be deposited on the fluidized catalytic reagent 15 which flows upward in the direction of arrow A, but due to its higher density, overflows into the outer reaction zone 24. In this, the catalytic reagent recycles between the inner reaction zone 22 and the outer reaction zone 24 as indicated by arrows B. The superheated air gasification identified by reaction (1) produces a low grade BTU gas in the order to 120–150 BTU/C.F.

The gamma-leg 24 of the gasification vessel 20 is also defined by the cylindrical stainless steel skirt 30 and consist of an outer annular reaction zone. Superheated steam 50 is delivered via supply line 52 from a steam generation plant (not shown). Preferably, a plurality of inlets peripherally spaced about the vessel 20 are provided for injecting the steam 50 into the vessel 20. The gamma-leg 24 is further supplied with heated catalytic reagent 15 having carbon deposited thereon which emerges from the inner reaction zone as indicated by arrows B. The heated catalytic reagent having deposited carbon operates in a percolation downward flow through the outer reaction zone 24 at a relatively reduced velocity as compared with the inner reaction zone 22. The gases produced in the outer reaction zone, however, flow upward into the third reaction zone 26. The primary chemical reaction occurring in the outer reaction zone 24 is steam gasification defined as follows:

$$C+H_2O+HEAT\rightarrow H_2+CO \quad (2)$$

The endothermic reaction (2) occurring in the outer reaction zone 24 produces a high grade BTU gas in the order of 300–325 BTU/C.F.

The novel gasification process and system of the present invention includes the coordinated interaction between the inner and outer reaction zones which provides advantageous process result. Without being bound by theory, in the inner reaction zone the upward fluidized bed uses superheated air to oxidize carbon, redeposit carbon on clean coal ash (thereby forming synthetic coal) and recycled synthetic coal 42, produce a low grade BTU gas, and to provide exothermic heat in accordance with reaction (1). In the outer zone 24 the downward percolation flowing bed uses superheated steam under endothermic heat to produce a high grade BTU gas in accordance with reaction (2). The process reagent 15 serves an important function in this regard. Specifically, the proper catalytic reagent must be selected which allows for circulation through both the inner and outer reaction zone in order to balance the exothermic heat of the inner reaction (1) and the endothermic heat of the outer reaction (2). Moreover, the catalytic reagent must be capable of being deposited with carbon originating from the coal. In this, the carbonated catalytic reagent flowing from the inner reaction zone 22 as indicated by arrow B carries the carbon necessary for reaction into the outer reaction zone 24. The catalytic reagent should have an intermediate density which is greater than that of synthetic coal in order to allow for the formation of the floating synthetic coal bed 26 on the one hand, and light enough to allow for fluidization on the other hand. The preferred process reagent of the present invention is sillimanite $Al_2O_3.SiO_2$. Sillimanite has a density in the order of 50 lbs. per cubic foot (hereinafter "lbs/c.f."). The sillimanite is injected and chemically combined with a catalytic agent in order to produce a catalytic process reagent as more fully described below. Various catalytic agents may be used such as sodium to yield $Al_2O_3.SiO_2.Na_2O$ or potassium to yield $Al_2O_3.SiO_2.K_2O$. However, the concentration of the alkaline injection is small in order to retain the primary reagent as $Al_2O_3.SiO_2$. Tests have shown that the optimal weight percent for the process reagent is in the order of 75% reagent and 25% catalytic agent. Tests have also shown that $Al_2O_3.SiO_2.Na_2O$ as an active catalytic process reagent lowers the process temperatures by about 1000° F. below prior art thermal gasification temperatures. Another acceptable process reagent is mullite $3Al_2O_3.2SiO_2$. Mullite has a density in the order of 54 lbs./c.f. Again, pulverized mullite is treated with sodium or potassium in order to provide a catalytic process reagent. Attapulgas clay can also be used as a recycle reagent with, however, increased yield in ash by-product. Other recycle reagents having properties described above are considered to be within the scope of the invention.

The catalytic reagent of the present invention maintains a clean gasification reactor and facilitates the fractionation and withdrawal of several relatively pure solid valuable by-products. The catalytic reagent of the present invention is a significant improvement over prior art catalytic reagents because it consists of a base material (e.g., sillimanite) having advantageous density and recycle characteristics and which chemically combines with a catalytic agent. No post reaction separation is required. In fact, the novel process and system of the present invention permits the catalytic reagent to self recycle in flowing from the first to second reaction zones due to the differential densities of the system products. In the prior art catalytic gasification processes, complex and cost prohibitive system components are necessary in order to separate the catalytic reagent from the coal ash for recycling or disposal. The dry coal carbon uniformly deposited on the recycled catalytic reagent (e.g., $Al_2O_3.SiO_2.Na_2O$) confirms that the superheated air-$CO_2$ jet instantaneously produces dry carbon and uniformly deposits the dry carbon on both the catalytic reagent and the recycled syn-coal. Dry gas (i.e., $H_2$ and CO) production is possible as the catalytic reagent and syn-coal circulate through the system as described in detail hereinafter. A minute amount of liquid tar is present on the recycled solids just sufficient to attach the dry carbon to the recycled catalytic reagent and the recycled syn-coal. This result is similar to petroleum catalytic cracking. The prior art liquid-phase is totally eliminated to avoid conglomeration in the process and to maintain clean hardware. The lighter gravity and size syn-coal, which is circulated via an external heating vessel 40 for preheating the recycled syn-coal and discharge of $N_2$—$CO_2$, has similar carbon deposit and gasification of the carbon deposit occurs. This process makes the coal ash an asset rather than a liability as in the prior art. In the prior art, coal-char (i.e., carbon on ash) is produced non-uniformly thereby severely degrading the process. The prior art coal char also produces troublesome liquid products.

The third reaction zone 26 is defined by the fluidized bed of synthetic coal. As previously noted, the fluidized bed of syn-coal is continuously stocked with re-carbonated recycled syn-coal 42 and with carbonated clean ash (i.e. syn-coal which has not yet been recycled). The fluidized bed of syn-coal floats on top of the moving catalytic reagent 15 of the inner 22 and outer 24 reaction zones. Specifically, the catalytic reagent has a density which is greater than that of syn-coal thereby causing the syn-coal to move upward and float on top of the recycle reagent. Syn-coal typically has a density in the order of 35 lbs./c.f. As shown in FIG. 1, a portion of the syn-coal is removed from the fluidized bed through supply line 46 and delivered to heating vessel 40 as more completely described below. Another portion of the syn-coal is removed from the fluidized bed through line 54 and delivered to a syn-coal conglomeration unit 108 as more completely described below with reference to FIG. 2.

The syn-coal withdrawal rates through lines 46 and 54 are controlled so as to maintain a constant deep syn-coal bed which provides for reaction zone 26. The syn-coal bed 26 is provided, in part, as a secondary reaction zone in order to react excess carbon deposited on the syn-coal with $CO_2$ gas flowing upward from the first inner reaction zone 22. The primary reaction in the syn-coal fluidized bed occurs as follows:

$$CO_2+C+HEAT \rightarrow 2CO \quad (3)$$

The source of the $CO_2$ which drives reaction (3) is from the inner reaction zone 22. The $CO_2$ which rises out of the inner reaction zone 22 is derived from several sources. First, as noted, superheated air 32 and $CO_2$ gas 34 are delivered into the inner reaction zone 22 from lime stone calcinator 36 via line 38. Second, in order to provide additional exothermic heat in the inner reaction zone 22, the carbon deposited on recycled syn-coal 42 and on the formed syn-coal is air oxidized to primarily produce $CO_2$. Moreover, $CO_2$ 60 is injected at the bottom 56 of the gasification vessel 20 through supply line 63 in order to establish adequate sealing between the inner 22 and outer 24 reaction zones. The unreacted $CO_2$ from these sources rises from the inner reaction zone 22 and into the third reaction zone 26 which is maintained directly above the inner 22 and outer 24 reaction zones.

The presence of a floating syn-coal fluidized bed 26 provides for advantageous results which contribute to the novel and superior process and system of the present invention. First, the unreacted carbon which has been deposited on the clean ash is reacted with $CO_2$ gas in accordance with reaction (3) to form additional high grade BTU gas (viz., approximately 300 BTU/C.F.). This is advantageous in that it increases overall system efficiency by maximizing the use of the carbonaceous fuel. Second, the controlled floating syn-coal fluidized bed allows for the withdrawal of valuable by-product which may be put to direct use or subjected to further processing. For example, the withdrawn syn-coal 62 may be delivered to a conglomeration unit 108 as more completely described below. Third, a portion of the syn-coal is withdrawn and delivered to a heating vessel 40 wherein the carbon of syn-coal is air oxidized and re-directed to the inner reaction zone 22 to provide additional process heat.

A portion of the syn-coal of the fluidized bed 26 is withdrawn through line 46 and delivered to reaction heating vessel 40. Compressed air 64 is delivered through line 66 into a lower portion of the vessel 40. The carbon of the syn-coal is reacted with the oxygen of the compressed air to provide the following exothermic reaction:

$$C+AIR\ (O_2) \rightarrow CO_2+N_2+HEAT \quad (4)$$

Reaction (4) produces a significant amount of process heat which is stored in the moving syn-coal mass and delivered, via line 44, into the inner reaction zone 22 as heated recycled syn-coal 42. The contaminate by-products of reaction (4) are typically $CO_2$ and $N_2$ 65. In utilizing a separate heating reaction vessel 40, the $CO_2$ and $N_2$ gases 65 may be easily retrieved from the top of the vessel 40 and delivered, via line 48, to a storage vessel or subjected to further processing. In this, a significant amount of process heat is created while avoiding the mixture of contaminate gas with useful grade BTU gas. Moreover, the heating vessel 40 provides for a significant amount of process operating flexibility. Specifically, the quantity and quality of the syn-coal recycled can be controlled and adjusted to accommodate the heat balance of the system. That is, if more exothermic heat is required in the inner reaction zone 22, an operator would increase the supply of heated recycle syn-coal 42.

The fourth upper reaction zone 28 serves as a hot lime treating section of the gasification vessel 20. The main purpose of the upper lime treating section 28 is to remove contaminate gas from the producer gas product. Specifically, the lime treating section 28 serves to eliminate the presence of $H_2S$ from the product as under the following reaction:

$$H_2S+CaO \rightarrow CaS+H_2O \quad (5)$$

Hydrogen sulfide ($H_2S$) gas is an undesirable sulfur by-product of coal gasification. Its presence in the product gas lowers BTU content and prevents direct commercial use. The upper lime treating zone 28 reacts the $H_2S$ with lime CaO (from a carbonate of calcium) in order to create a manageable and easily removable solid by-product CaS 70. The upper lime treating zone 28 is contained in an upper section of the gasification vessel 20 and separated from the third reaction zone 26 by a connecting partition 82. Hydrogen sulfide $H_2S$ gas produced as a by-product in the inner reaction zone 22 travels into the lime treating zone 28 through partition 82. Lime 72 is delivered to the upper reaction zone 28 via supply line 78. The lime 72 is delivered from limestone calcinator 36 as a by-product of reaction (6). The lime 72 and $H_2S$ gas react in accordance with reaction (5) to produce CaS and $H_2O$. Significantly, the CaS 70 has a lower density (viz., in the order of 60 lbs./c.f.) than the lime 72 (viz., in the order of 80 lbs./c.f.) and, thus, floats on top of the lime 72. In this, the CaS 70 can be easily removed as a clean by-product from the upper reaction zone 28 through withdrawal line 76. Limestone $CaCO_3$ 74 is formed in a secondary reaction of the upper reaction zone. Again, the limestone 74 has a greater density (viz., in the order of 70 lbs./c.f.) than CaS 70 and, therefore, settles on the partition 82 for removal through line 80. The withdrawn limestone 74 is transported, via line 80, to the limestone calcinator 36 for further processing as fully set forth below. The lime treating zone 28 allows for the removal of the contaminate gas $H_2S$ as a clean by-product CaS. Moreover, secondary reactions occurring in the upper reaction zone 28 provide for the removal of contaminate $CO_2$ gas in order to increase BTU content of the product gas. The upper treating zone 28 is advantageous to the overall gasification process and system 10 in that it increases the quality of the final gas product and decreases the amount of waste by-products.

The novel process and system of the present invention allows for reduction of operating pressures and temperatures. In using the novel catalytic reagent and system arrangement of the present invention, the necessary process reactions (viz., air and steam gasification) occur at substantially lower temperatures and pressures over prior art thermal systems. The operating reaction temperatures are reduced in order of 1000° F. below prior art thermal processes. In this, the need for complex insulation and cooling systems, expensive reaction vessels, and manufactured oxygen is eliminated. The operating parameters of the gasification reactor 20 include a vessel pressure in the order of 175 p.s.i.g. and a vessel temperature profile in the order of 850°–1650° F. The temperature of the hot air 32 and $CO_2$ gas 34 is in the order of 1650°–1700° F. Generally, the results of the process of the present invention can be achieved when the reaction vessel is maintained with a pressure in the range of 150 to 200 p.s.i.g. and a temperature profile in the range of 850° to 1700° F. The temperature of the recycled syn-coal 42 delivered into the inner reaction zone is in the order of 1600°–1620° F. The $N_2$ and $CO_2$ vent gases 65 from the syn-coal heating vessel 40 are removed at a temperature in the order of 1800°–1810° F. The gas flow rates required to create the flow of solids in the gasification vessel 20 depend on the type of coal used in the process. For example, gas flow rates in the range of about 2–10 ft/sec. are suitable for the desired fluidization within the inner zone. Fluidization of solids including coal has been known in the art for many years and, therefore, is within the skill of a person having ordinary skill in the art. Typically, upward fluidization occurs at approximately 6 to 10 ft/sec. As disclosed in my U.S. Pat. No. 4,555,249, flow rates from 2 to 8 ft/sec. promote fluidization.

The product gas 84 is removed through a valve 86 located on the top of the gasification vessel 20 and delivered, via line 88, to a storage vessel (not shown). Preferably, however, the product gas 84 is first injected through a standard commercial filter (not shown), such as a cyclone, for removal of any unwanted solid impurities. Significantly, the product gas 84 is a medium grade BTU gas having direct commercial applicability. The product gas 84 is preferably a medium grade BTU gas having a content in the range of 200–250 BTU/C.F. The product gas 84 is derived from the mixing of the low grade BTU gas of the inner reaction zone 22 and the high grade BTU gas of the outer reaction zone 24. The BTU content of the product gas 84 will vary depending on the particular system inputs. The product gas 84 can be stored in transport vessels and transported for direct commercial use by a consumer. For example, the product gas 84 could be stored and delivered to a service station for use in automobiles having gas engines. Alternatively, the product gas 84 could be delivered directly on site to a gas turbine for the creation of electricity for delivery to the consuming public or use by manufacturing facilities. No additional costly and environmentally harmful treatment is required to be performed. Significantly, the source of in process oxygen for the process of the present invention originates from steam, $CO_2$, and air through carbon reactions. The product gas 84 of the present invention has direct commercial applications and is provided without the use of manufactured oxygen.

As previously discussed, superheated air 32 and $CO_2$ 34 are delivered to the inner reaction zone 22 in order to drive reaction (1). The source of hot air 32 and $CO_2$ 34 is derived from the limestone calcinator vessel 36. The limestone calcinator vessel 36 is supplied with limestone 74 via supply line 90. The source of the limestone 74 is from make up and the upper lime treating zone 28 of the reactor vessel 20. The limestone 74 is transported, via line 80, to at least a pair of lock bins (not shown) from which supply line 90 delivers the limestone 74 into an upper portion of the reaction vessel 36. Similarly, a portion of the syn-coal 62 withdrawn from the syn-coal fluidized bed 26 of the gasifier reactor 20 is delivered, via line 54, to at least a pair of lock bins (not shown). The syn-coal is then withdrawn as needed from the lock bins and delivered, via supply line 92, to a mid-section of the reaction vessel 36 as shown in FIG. 1. Compressed air 64 is delivered, via supply line 68, to the bottom of the reaction vessel 36 as indicated in FIG. 1. The compressed air 64 is supplied from product gas 84 expanders (not shown) and steam driven compressor (not shown) which may be designed to utilize system products depending upon client desires and the integration of outside plant facilities. The reaction vessel 36 contains the following primary reactions:

$$CaCO_3 + HEAT \rightarrow CO_2 + CaO \quad (6)$$

$$\text{SYN-COAL (C)} + \text{AIR } (O_2) \rightarrow \text{HOT } CO_2 + \text{EXCESS AIR} \quad (7)$$

The primary reaction (6) yields $CO_2$ gas and lime 72. Due to its density, the lime 72 settles on the bottom of the reaction vessel 36 as shown in FIG. 1. The lime 72 is then easily withdrawn from the vessel 36, via line 96, and delivered to a holding vessel (not shown) for temporary storage. From the holding vessel, the lime 72 is withdrawn, as necessary, and delivered, via line 78, to the lime treating zone 28 of the gasifier vessel 20. Reaction (7) produces the desired hot $CO_2$ gas and air which is captured at the top of the reaction vessel 36 and diverted, via line 38, to the inner reaction zone 22 of the gasifier 20. Coal ash 98 is an additional by-product of the reactions of the limestone calcinator vessel 36. Coal ash 98—having a density in the order of 40 lbs./c.f.—floats on top of the lime 72 in the vessel 36 and is withdrawn and delivered, via line 94, to a storage vessel (not shown). The coal ash 98 may then be delivered to the coal/reagent blending vessel (not shown) for recycling through the gasifier. The limestone calcinator provides for hot $CO_2$ gas and air ($O_2$) which are used in the gasification process. The novel system 10 is designed such that the limestone calcinator vessel 36 operably interacts with the gasifier vessel 20 to utilize the reaction by-products for the production of in process hot $CO_2$ gas and air ($O_2$).

The heavy metals 100 contained in the coal 13 settle at the bottom of the gasifier vessel 20 and are withdrawn and delivered, via line 102, to a storage vessel (not shown). The heavy metal inorganic by-products may then be safely and conveniently removed and delivered for sale or to a disposal site. The conversion of organic metals to inorganic metals facilitates the removal of coal metals 100. Furthermore, any remaining traces of coal metals are absorbed by the catalytic reagent 15 and removed during purification of the catalytic reagent as described below. Any process reagent 15 which is not effectively delivered to the inner reaction zone 22, is withdrawn out of the bottom of the reaction vessel 20. The recycled reagent 104 is delivered, via line 106, to recycled reagent lock bin (not shown) from where it may then be delivered to the coal/reagent blender (not shown) for reprocessing. The recycling of the catalytic reagent in this manner increases the overall efficiency of the gasification system 10.

Figure 2:
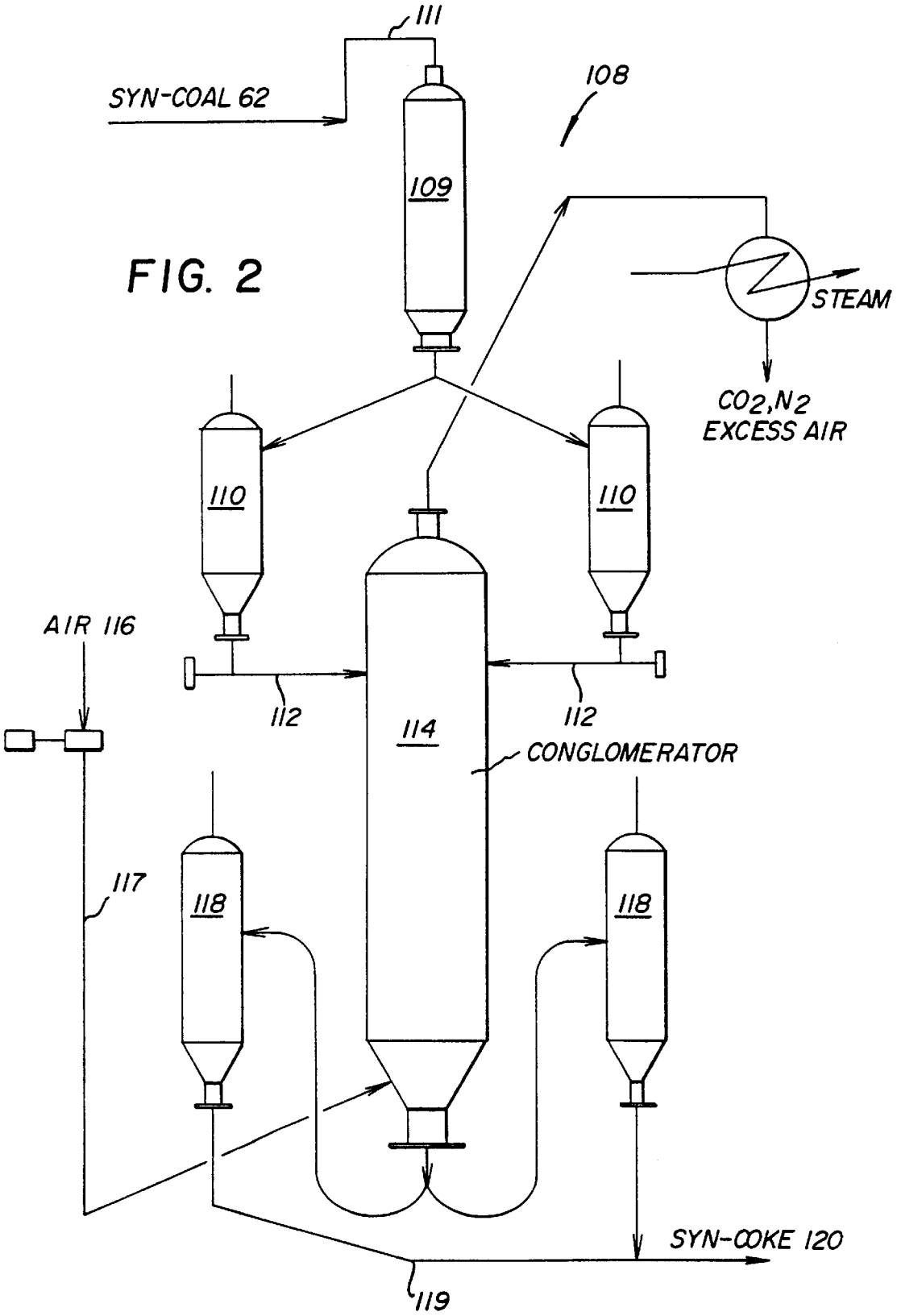
FIG. 2 is a schematic drawing of components of the synthetic coal conglomeration unit of the gasification process and system of the present invention.

Further economic improvement can be made by further downstream processing of the syn-coal 62 withdrawn from the fluidized bed 26 of the gasifier vessel 20. Referring now to FIG. 2, there is shown a syn-coal conglomeration system 108. Simply, the system 108 processes the syn-coal 62 in order to form lump coke 120 having direct commercial utility. Generally, coke is a solid carbonaceous residue having no volatile material which is a common fuel source used in manufacturing steel. The lump coke of the present invention can replace metallurgical coke for burning in steel blast furnaces. The lump coke 120 of the present invention is produced at approximately one-half the production cost of metallurgical coke.

The syn-coal 62 which has been withdrawn from the fluidized bed 26 of the gasifier vessel 20 is first delivered to a temporary storage vessel (not shown) from which a portion of the syn-coal is delivered to the limestone calcinator 36 as previously described with reference to FIG. 1. Most of the syn-coal 62, however, is withdrawn and delivered, via line 111, to hopper 109. The syn-coal 62 is then gravitated into at least a pair of lock-bins 110. Variable speed screw drives 112 force the powdered syn-coal 62 into a conglomerator reactor vessel 114. Compressed air 116 is additionally delivered, via line 117, to the conglomerator as a driving reactant. The air 116 then burns a sufficient amount of the carbon of the syn-coal 62 in order to melt a portion of the ash of the syn-coal 62 to conglomerate the syn-coal 62 into lump coke. The heavier lump coke then gravitates into the lock-bins 118. The lump coke 120 is then withdrawn and delivered, via line 119, to a storage facility for transport to a commercial site.

The novel process and system 10 of the present invention can be further described and demonstrated with reference to several developmental test runs which have produced the identified results.

Example I

| | |
|---|---|
| System Input | |
| reagent catalyst: $Al_2O_3.SiO_2.Na_2O$ | |
| coal feed rate (12,000 BTU coal) | 5 TPD |
| recycle reagent withdrawn to blend | 1 TPD |
| Product Yields | |
| 225 BTU gas | 4.5 MMBTU/hr. |
| CaS | .38 TPD |
| heavy metal concentrate | .03 TPD |
| ash | .43 TPD |
| Operating Parameters | |
| gasifier pressure | 175 p.s.i.g. |
| gasifier temperature profile | 875–1650° F. |
| calcinator air-$CO_2$ to gasifier | 1700° F. |
| syn-coal recycle to gasifier | 1650° F. |
| syn-coal external heater vent | 1800° F. |

-continued

| | |
|---|---|
| oxygen source | |
| from air | 34% |
| from steam | 28% |
| from $CO_2$ | 38% |

Example II

| | |
|---|---|
| System Input | |
| reagent catalyst $Al_2O_3.SiO_2.Na_2O$ | |
| coal feed rate (12,000 BTU coal) | 10 TPD |
| recycle reagent withdrawn to blend | 2 TPD |
| Product Yields | |
| 225 BTU gas | 4.5 MMBTU/hr. |
| syn-coal | 4.1 TPD |
| CaS | .75 TPD |
| heavy metal concentrate | .06 TPD |
| ash | .40 TPD |
| Operating Parameters | |
| gasifier pressure | 175 p.s.i.g. |
| gasifier temperature profile | 870–1700° F. |
| calcinator air-$CO_2$ to gasifier | 1660° F. |
| syn-coal recycle to gasifier | 1620° F. |
| syn-coal external heater vent | 1810° F. |

Example III

System Input Same as Example I except Illinois coal containing organic chlorine was the feed stock Product Yields Same as Example I Operating Parameters Same as Example I Disposition of Chlorine 1. add sufficient $BaCO_3$ to lime treating zone 28;
2. during gasification and hot treating the following reaction occurs:

$$2HCl+BaCO_3 \rightarrow BaCl_2+H_2O+CO_2$$

3. add external cold air fluidized bed to separate out $BaCl_2$ from $CaCO_3$ and excess CaO;
4. the specific gravity of elements is as follows:

| | |
|---|---|
| $BaCl_2$ | 3.856 |
| $BaCO_3$ | 4.43 |
| CaO express | 3.346 |
| $CaCO_3$ | 2.93 or 2.71 |

5. the $BaCl_2$ and excess $BaCO_3$ have commercial value and can be utilized in chemical plant operations.

In order to determine the quality of the product syn-coal of the above developmental runs, several tests were performed. A magnet test indicated that no heavy metals were present. A chemical test indicated that no sulfur, tar oils, water, or halogens were present in the product syn-coal. The production of a syn-coal by-product free of contaminates is a substantial improvement over prior art systems. The novel process and system of the present invention allows for the production of a valuable reaction by-product having direct commercial value.

The process and system 10 of the present invention provides for an economical way to produce medium grade BTU gas which has direct commercial utility. Significantly, the process and system 10 of the present invention does not require the use of manufactured oxygen. The source of in-process oxygen is derived from steam, $CO_2$, and air through carbon reactions. In avoiding the requirement of manufactured oxygen, the process and system 10 of the present invention can produce medium grade BTU gas having direct commercial utility at substantially reduced cost. Moreover, in using the novel catalytic reagent of the present invention, the need for complex and cost prohibitive post reaction separation hardware is avoided. The novel process and system of the present invention thereby reduces capital cost to about one-third and product production cost to about one-half. In this, the process and system 10 of the present invention can be commercialized by a wide variety of electrical producers, manufacturing companies, coal deposit owners, and the like in order to produce medium grade BTU gas having direct commercial utility. The process and system 10 of the present invention provides for an economical way to produce medium BTU gas having direct commercial utility which, when commercialized, would provide an incentive for product manufacturers (e.g. automobile manufactures) to increase product production for products which operate from clean gas. The process and system 10 of the present invention provide for an economical way to utilize the world's most abundant fuel source (viz., coal) in order to produce medium BTU gas having direct commercial utility. The synergistic relationship between the four reaction zones allows for an increase in thermal efficiency over the prior art systems from approximately 72% (prior art systems) to 89%.

Moreover, the process and system 10 of the present invention provides an economical way to produce medium grade BTU gas having direct commercial utility with virtually no solid or liquid waste products. The process and system 10 of the present invention provides for maximum usage of the system by-products in order to create additional products having commercial value as fully discussed below.

Figure 3:
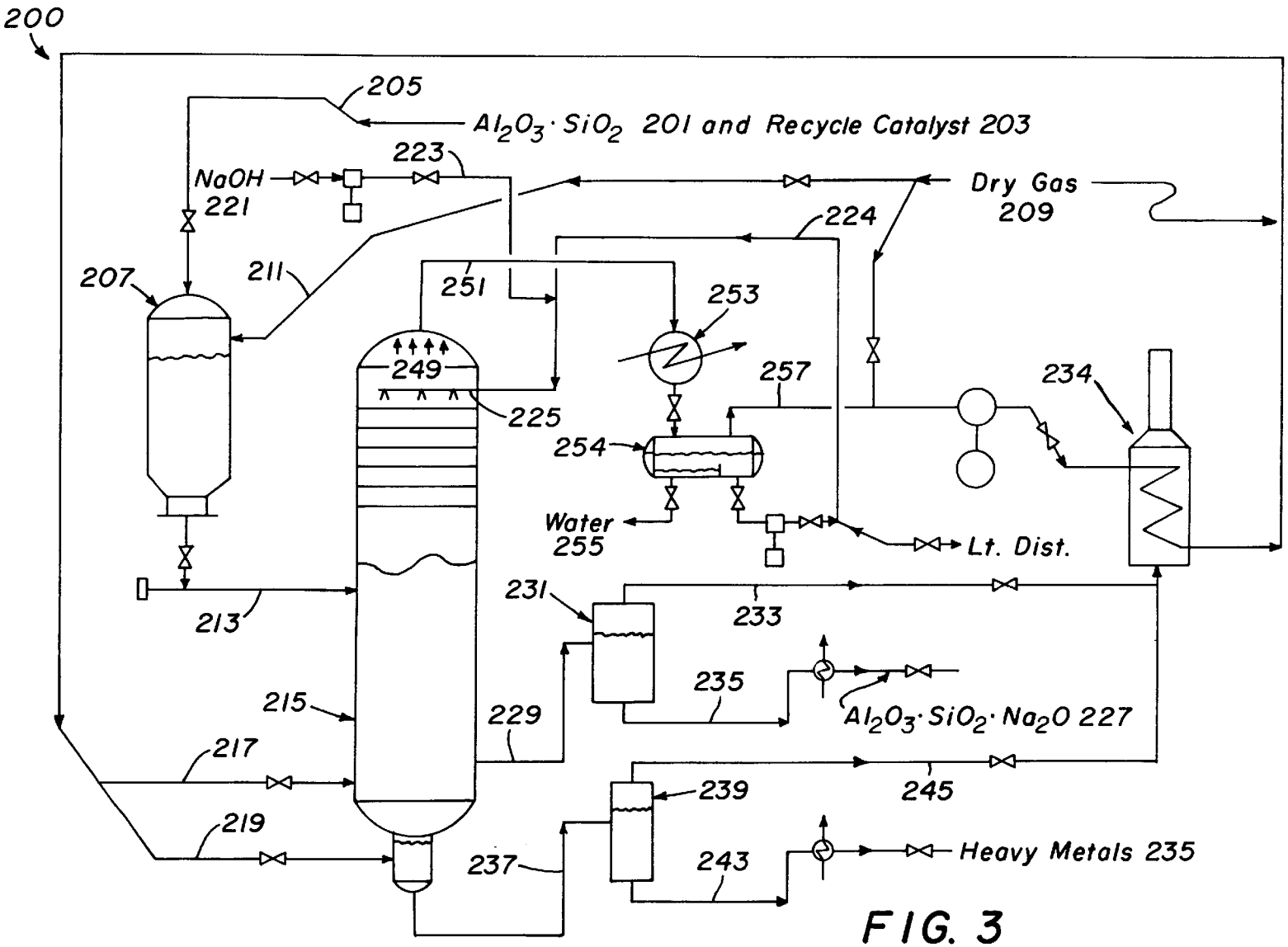
FIG. 3 is a schematic drawing of primary components of the catalyst preparation and purification process and system of the present invention.

FIG. 3 shows a process and system 200 for the preparation and continuous purification of a novel catalytic process reagent. Water is removed during catalyst preparation and heavy metal impurities are removed from recycled process catalyst during purification. During the gasification process trace metals such as mercury, arsenic, vanadium, etc., are removed from the process by the catalytic reagent. These heavy metals are then extracted from the recycled catalytic reagent by decomposition of the heavy metals using recycled dry gas from the gasification vessel 20. The catalyst preparation and purification results have been confirmed in successful catalytic cracking commercial test runs.

$Al_2O_3.SiO_2.Na_2O$ is one preferred example of a new catalytic reagent prepared by the process and system 200. $Al_2O_3.SiO_2.Na_2O$ is produced by reacting sillimanite ($Al_2O_3.SiO_2$) with NaOH in the presence of heated dry gas and a light distillate to remove water. In addition, heavy metal impurities in the recycled catalyst are removed by the dry gas and precipitated for bottom removal from the reaction vessel. Since the superheated dry gas strips the solids for dry removal and then the distillate removes the water, the $Na_2O$ reacts with the $Al_2O_3.SiO_2$ by intimate contact. A process reagent 201, such as sillimanite or mullite, and recycled catalytic reagent 203, from a 2 to 20% slipstream from the gasification vessel 20 of FIG. 1, are fed, via supply line 205, into a lock bin 207. Dry gas 209 (a mixture of $H_2$ and CO) is fed, via supply line 211, into the top of the lock bin 207 under pressure forcing the process reagent 201 and the recycled catalyst 203 out of the lock bin 207, via a screw drive 213, into a fractionator 215. Heated dry gas 209 is fed, via supply lines 217 and 219, into the bottom of the fractionator 215. A catalytic agent 221, such as NaOH or KOH, is fed, via supply line 223, to a supply line 224 containing a light distillate, such as naphtha, circulating in a closed circuit with the fractionator 215. The catalytic agent 221 and light distillate mixture is injected into the fractionator 215 via spray nozzles 225. The following reactions occur in the fractionator 215:

$$2NaOH \text{ (or } 2KOH) + HEAT \rightarrow Na_2O \text{ (or} K_2O) + H_2O \quad (8)$$

$$\text{PROCESS REAGENT} + \text{RECYCLED CATALYST} + Na_2O \text{ (or } K_2O) \rightarrow \text{PROCESS REAGENT.}Na_2O \text{ (or } K_2O) \quad (9)$$

| Exemplary Process Parameters | |
|---|---|
| pressure | 5–15 p.s.i. |
| temperature | 300–1000° F. |
| dry gas temperature | 1000° F. |
| catalytic agent temperature | ambient |
| process reagent particle size | 30–300 mesh |
| catalytic agent concentration | 30% |

Preferably, the catalytic reagent obtained has in the range of about 25% $Na_2O$ (or $K_2O$) and about 75% sillimanite (or mullite) and is in the form of dry solid particles having particle sizes in the range of about 15–200 mesh. The catalyst 227 is removed from the fractionator 215, via line 229, to a storage tank 231. Unreacted dry gas 209 is separated from the catalyst 227 and removed, via line 233, to a heater 234 for fuel gas. The catalyst 227 is removed from the storage tank 231, via line 235, and may be delivered, for example, to a blender (not shown) for mixing with fine coal. Heavy metal impurities 235 are withdrawn from the bottom of the fractionator 215, via line 237, to a storage tank 239 from where the heavy metals are removed, via line 243, as by-product and the dry gas 209 is removed, via line 245, to the heater 234 for fuel gas. A mixture of water, dry gas and naphtha 249 is removed from the top of the fractionator 215, via line 251, to a condenser 253 and then to a drum 254. The water is removed from the drum 254, via line 255, the dry gas is removed, via line 257, to the heater 234 for fuel gas and recycling back to the fractionator 215 after heating and the naphtha is recycled back to the fractionator 215 via line 224.

Figure 4:
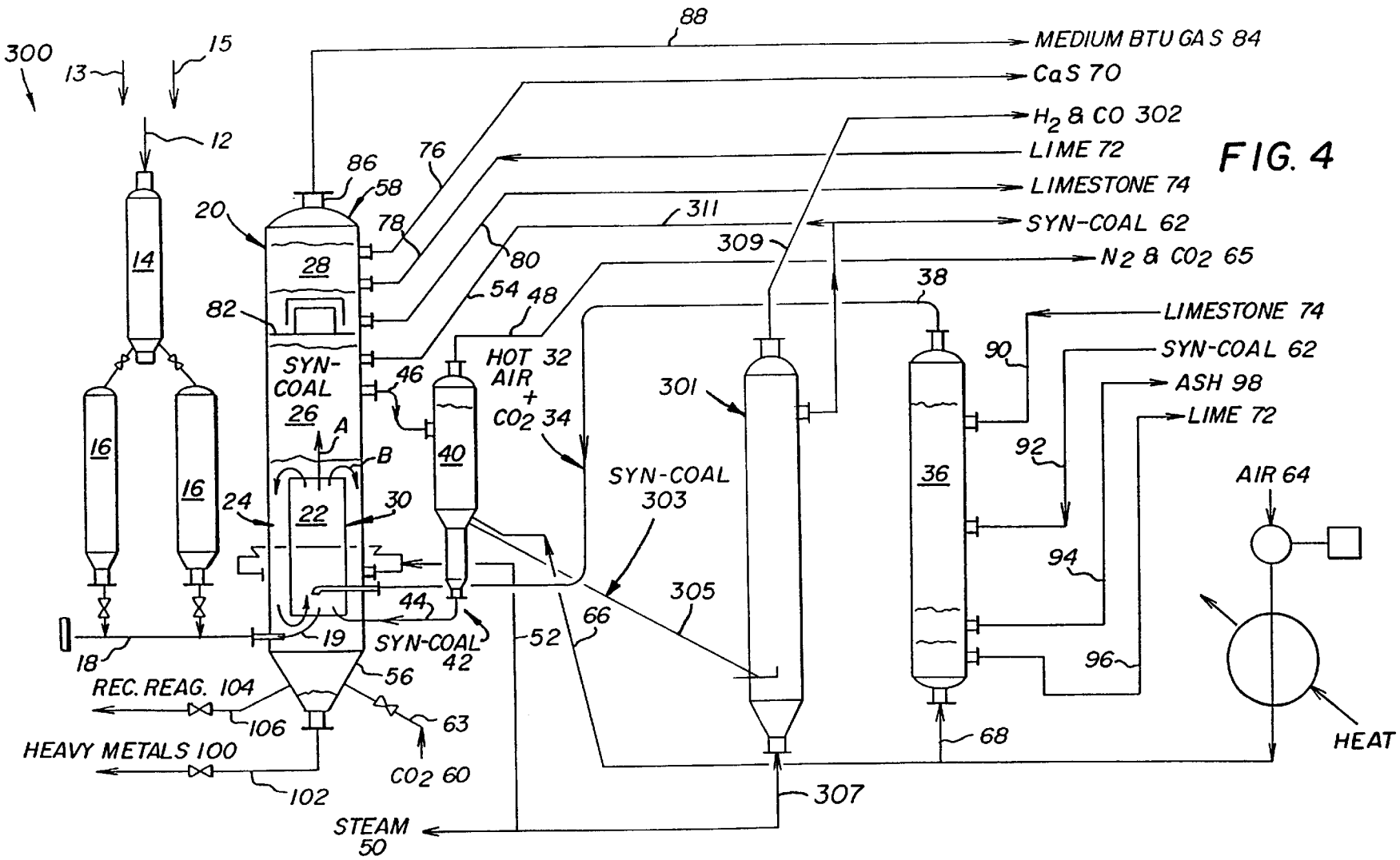
FIG. 4 is a schematic drawing of primary components of the dry gas ($H_2$ and CO) preparation process and system of the present invention.

Referring now to FIG. 4, a process and system 300 are shown for producing dry gas, i.e., a mixture of $H_2$ and CO. The process and system 300 of FIG. 4 are similar to the process and solid gasification system 10 of FIG. 1 with like parts having the same numbers. A second catalytic gasifier 301 for producing dry gas 302 is included in the gasification system 300 of FIG. 4. Syn-coal 303 is withdrawn from the heater 40, via line 305, and introduced into the second catalytic gasifier 301. The syn-coal 303 has a temperature in the range of about 1000° F. to 1800° F., preferably in the range of about 1100° F. to 1500° F., and more preferably in the range of about 1200° F. to 1400° F. Superheated steam 50 is injected into the bottom of the second catalytic gasifier 301 via line 307. The superheated steam 50, having a temperature in the range of about 600° F. to 1000° F., preferably in the range of about 700° F. to 900° F., and more preferably about 800° F., reacts with the syn-coal 303 in the second catalytic gasifier 301 to produce dry gas 302 by the following reaction:

$$\text{SYN-COAL (C)} + \text{STEAM } (H_2O) \rightarrow CO + H_2 \quad (10)$$

The dry gas 302 is removed from the top of the second catalytic gasifier 301, via line 309, for further use as desired. The syn-coal 303 is also removed from near the top of the second catalytic gasifier 301. A slipstream of syn-coal 303 is fed back into the primary gasifier 20 via line 311.

Figure 5:
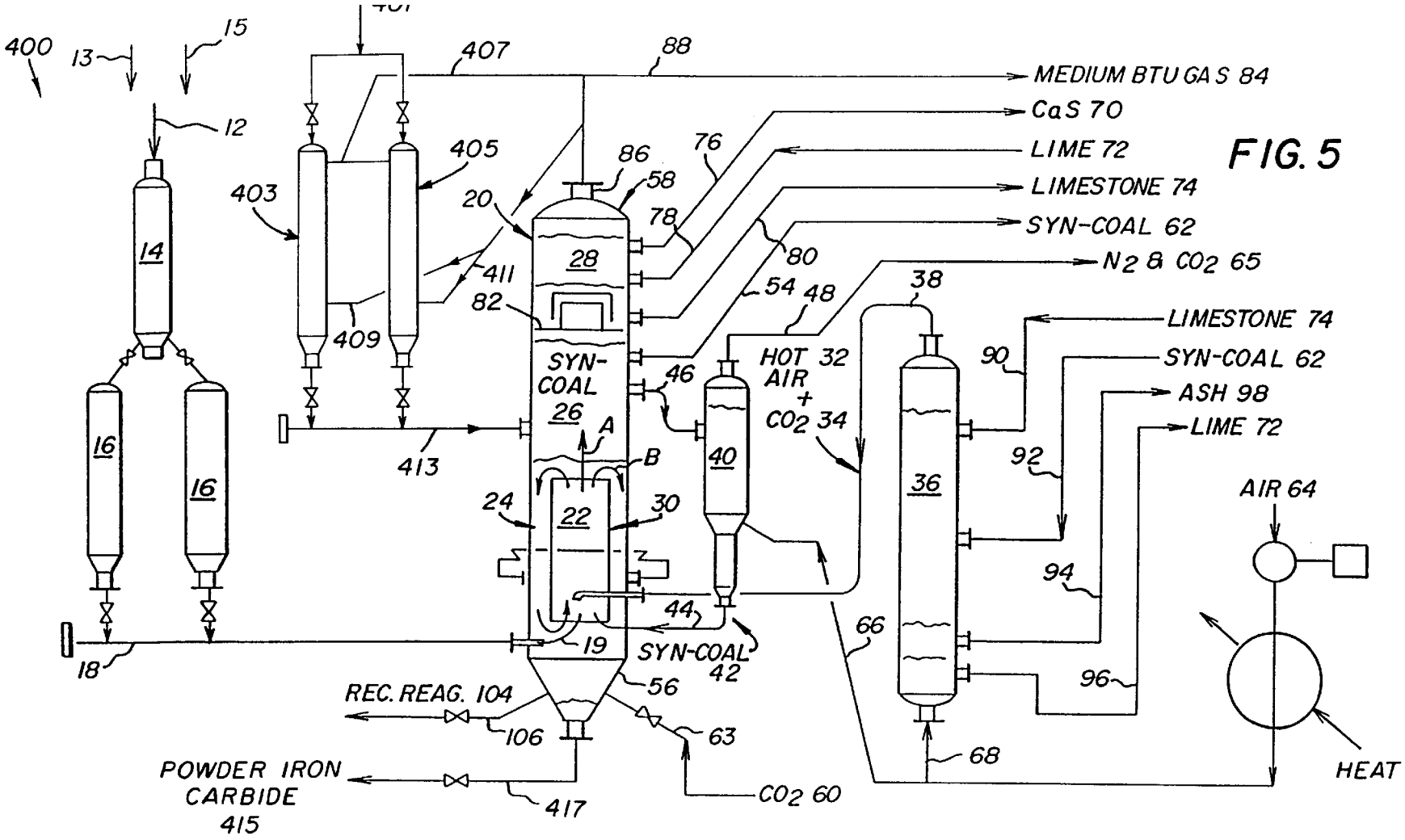
FIG. 5 is a schematic drawing of primary components of the iron carbide preparation process and system of the present invention.
Figure 6:
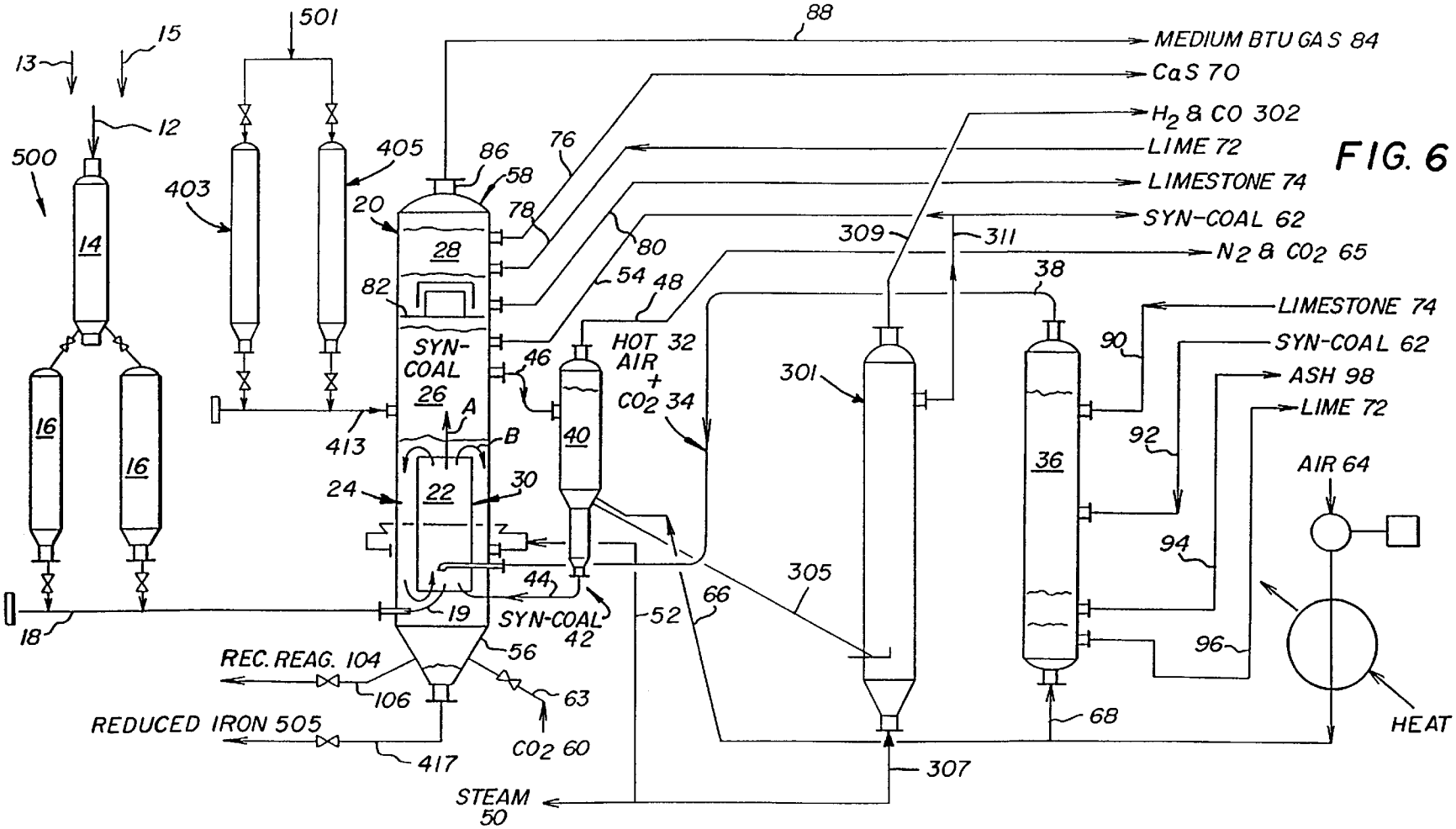
FIG. 6 is a schematic drawing of primary components of the iron preparation process and system of the present invention.

Referring now to FIGS. 5 and 6, experimental pilot plant work has been done to evaluate catalytic direct iron reduction via a two-step process to convert powdered iron oxides to iron carbide (discussed in connection with FIG. 5) and then to reduced iron (discussed in connection with FIG. 6 below). Recycled superheated and carbonated catalytic reagent, having a temperature in the range of about 900° F. to 1500° F., preferably in the range of about 1000° F. to 1400° F., and more preferably in the range of about 1300° F., is used to remove all oxygen from preheated powdered iron oxide ore. The iron oxide ore has a temperature in the range of about 500° F. to 900° F., preferably in the range of about 700° F. to 800° F., and more preferably of about 750° F., and a particle size in the range of about 100 to 300 mesh. The iron ore reacts with carbon from carbonated catalytic reagent to yield iron carbide. The oxygen removed from the iron oxide ore reacts with carbon to yield CO gas which exits upward. The iron carbide and the recycled catalytic reagent flow downward to a percolation zone and a differential gravity separation zone. The iron carbide discharges at the reaction vessel's bottom while the catalytic reagent recycles upward. Since the iron carbide contains carbon as fuel, the iron carbide can be injected into other components of conventional processes of a steel plant, such as an electric furnace. The iron reduction can be completed in a second system (FIG. 6) in series by injecting the iron carbide into the system and removing the carbon with controlled injection of superheated steam. In this, enough steam is injected in a controlled manner to remove substantially all of the carbon from the iron carbide. It will be appreciated by a person of skill in the art, that the amount of steam required to remove substantially all of the carbon from the iron carbide can be easily determined using trial runs and that injection of excessive steam can reoxidize the iron whereas insufficient steam would not remove substantially all of the carbon from the iron carbide. CO and $H_2$ gas flow upward and the reduced iron flows downward for bottom removal. Recycled dry gas ($H_2$ and CO) cools and blankets the iron to maintain the reduced state through intermediate storage. The catalytic coal gasification process and system of the present invention use low cost hot clean energy for direct iron reduction. Oxygen recovery and use lowers the production costs of the catalytic direct iron reduction. A comparison between catalytic production of iron carbide and thermal iron carbide production is given below:

| | Thermal | Catalytic |
|---|---|---|
| $Fe_3C$ | 93% | 98% |
| FeO | 4% | 1% |
| Gangue | 3% | 1% |
| C in $Fe_3C$ | 6.2% | 6.5% |

The contaminant gangue from the iron ore has a lower density and, therefore, in the catalytic process it is separated. The gangue follows the flow of the syn-coal, which is carried to the limestone calcinator 36, and is removed with the coal ash. Since the catalytic reactor 20 has a conical bottom 56, the $Fe_3C$ produced provides a concave flow to the bottom central discharge nozzle thereby forcing the recycled catalytic reagent to flow upward through the central fluidized zone. The recycled gas cools, strips, and separates the $Fe_3C$ and recycled catalytic reagent including the gangue. The additional retention time for complete removal of oxygen from the iron ore and formation of the $Fe_3C$ is controlled to substantially eliminate FeO release.

In FIG. 5 a process and system 400 are shown for production of iron carbide. The process and system 400 are similar to the process and catalytic gasification system 10 of FIG. 1 with like parts having the same numbers. Powdered iron oxides 401 are stored in lock bins 403 and 405. Medium grade BTU gas 84 from the gasification vessel 20 is injected, via supply lines 409 and 411, into the lock bins 403 and 405 and then recycled back, via line 407, to the supply line 88. The medium grade BTU gas 84, having a temperature in the range of about 700° F. to 1200° F., preferably about 900° F., preheats the iron oxides 401 to improve the efficiency of the reactions. The preheated iron oxides 401 are introduced, via line 413, into the gasification vessel 20. The powdered iron oxides 401 are reduced to powdered iron carbide 415 by the following reaction:

$$\text{C+IRON OXIDE+HEAT} \rightarrow \text{CO+Fe}_3\text{C} \quad (11)$$

The heavier powdered iron carbide 415 is removed from the bottom 56 of the gasification vessel 20 via line 417 to intermediate storage (not shown). In this embodiment of the present invention, superheated steam 50 is not necessary and, therefore, is not introduced in the gasification vessel 20.

The novel process and system 400 of the present invention can be further described and demonstrated with reference to test runs which have produced the identified results.

Example IV

| | |
|---|---|
| System Input | |
| reagent catalyst: $Al_2O_3.SiO_2.Na_2O$ | |
| coal feed rate (12,000 BTU coal) | 5 TPD |
| iron oxides feed rate | 4 TPD |
| limestone | 0.3 TPD |
| Product Yields | |
| iron carbide | 2.9 TPD |
| 225 BTU gas | 3.0 MMBTU/hr |
| CaS | 0.38 TPD |
| heavy metal concentrate | 0.03 TPD |
| ash | 0.43 TPD |
| Operating Parameters | |
| gasifier pressure | 25 p.s.i.g. |
| inlet air-$CO_2$ to gasifier | 1200 to 1700° F. |
| syn-coal recycle to gasifier | 1100 to 1600° F. |
| oxygen source | |
| from air | 34% |
| from iron ore | 28% |
| from $CO_2$ | 38% |

In FIG. 6 a process and system 500 are shown for producing iron. The process and system 500 are similar to the process and system 400 of FIG. 5 and also include the second catalytic gasifier 301 of FIG. 4 with like parts having the same numbers. In the process and system 500, superheated steam 50, having a temperature in the range of about 600° F. to 1000° F., preferably in the range of about 700° F. to 900° F., and more preferably about 800° F., is injected via line 52 into the gasification vessel 20. Powdered iron carbide 501, having particle size in the range of about 100 to 300 mesh, is stored in lock bins 403 and 405 and fed by screw drive 413 into the gasification vessel 20. The powdered iron carbide 501 is reduced to iron by the following reaction:

$$\text{Fe}_3\text{C+H}_2\text{O+HEAT} \rightarrow \text{3Fe+CO+H}_2 \quad (12)$$

The reduced iron 505 is removed from the gasification vessel 20 via line 417.

Figure 7:
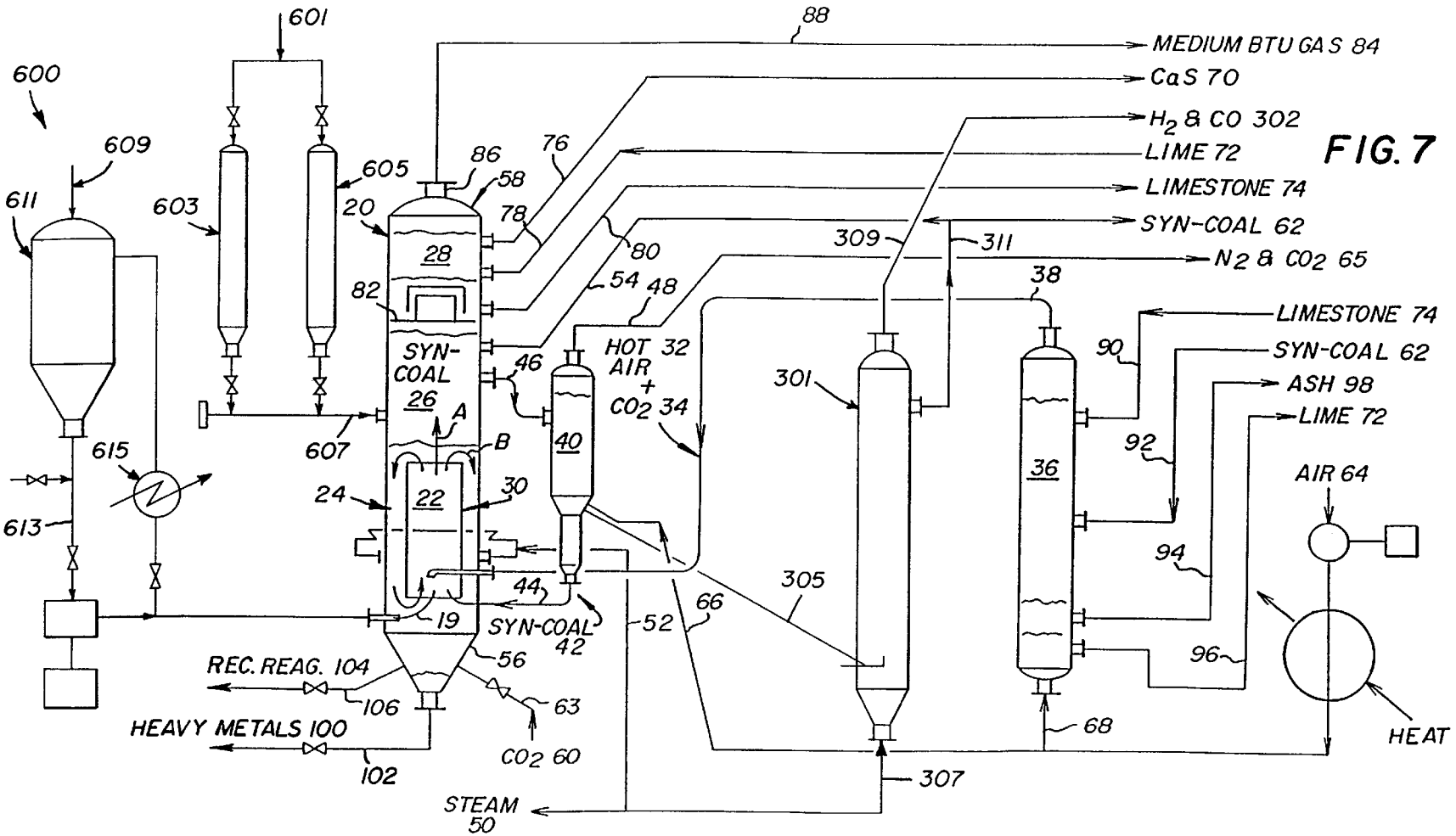
FIG. 7 is a schematic drawing of primary components of the residual petroleum fuels gasification process and system of the present invention.

Referring to FIG. 7, a process and system 600 are shown for catalytic gasification of residual petroleum fuels. In this, residual petroleum fuels are the residues left over after liquid products have been removed from crude oil, such as, for example, asphalt, No. 6 heavy fuel. The process and system 600 are similar to those in FIG. 1, but coal feed is replaced with powdered petroleum coke (pet-coke) 601, having particle size in the range of about 100 to 300 mesh, which is stored in lock bins 603 and 605 and fed, via screw drive 607, into the gasification vessel 20. Also, preheated residual petroleum fuels 609 are stored in storage tank 611 and fed, via supply line 613, into the gasification vessel 20. In this, petroleum coke or pet-coke is product made in refining petroleum wherein after the useful liquid products have been removed from crude oil the heavy residues are charged to a coke unit to obtain powdered carbon product. Heater 615 is provided for preheating the residual petroleum fuels 609. It will be appreciated that the residual petroleum fuels are heated to liquidify them and have a temperature in the range of about 500° F. to 1000° F., preferably of about 800° F. The catalytic gasification process and system 600 may be applied to residual petroleum fuels including pet-coke and preheated heavy fuels. The process can also include the conversion of natural gas to $H_2$ and CO. The petroleum coke 601 and residual petroleum fuels 609 are gasified according to reactions (1) to (5) with the exemplary parameters in Examples I to III applying.

SUMMARY OF MAJOR ADVANTAGES OF THE INVENTION

After reading and understanding the foregoing detailed description of a catalytic gasification process and system for the production of medium grade BTU gas and other products in accordance with preferred embodiments of the invention, it will be appreciated that several distinct advantages of the subject process and system are obtained.

Without attempting to set forth all of the desirable features of the instant gasification process and system, at least some of the major advantages include providing a gasification reactor vessel 20 having four reaction zones 22, 24, 26, and 28. In the first reaction zone 22, air gasification of the carbon of the fine coal 13 occurs yielding a low BTU gas in an upward fluidization mode. Moreover, the air jet 32 strikes the dried pulverized coal 13, reagent 15, and recycled syn-coal 42 to deposit the carbon from the coal onto the coal ash, catalytic reagent 15, and recycled syn-coal 42. In the second reaction zone 24, superheated steam gasification of the carbon deposited on the hot recycle reagent 15 occurs yielding high grade BTU gas (e.g. approximately 300 BTU/C.F.). The steam gasification occurs in a downward percolation mode for the solid particles and an upward flow for the product gas. The system reagent 15 is selected so as to provide circulation through both the inner and outer reaction zone in order to balance the exothermic heat of the inner reaction (1) and the endothermic heat of the outer reaction (2). A process and system is provided for the preparation and purification of a novel catalytic recycle reagent having an intermediate density which is greater than that of synthetic coal in order to allow for the formation of the floating synthetic coal bed 26. The reagent is selected to permit chemical bonding between the reagent and the catalytic agent. The preferred recycle reagent of the present invention is sillimanite $Al_2O_3.SiO_2$.

In the third reaction zone 26, the carbon of the syn-coal is reacted with residual $CO_2$ in order to increase the production of high grade BTU gas and produce additional endothermic reaction heat for heat recovery. This sequential cooling improves plant efficiency. A deep syn-coal fluidized bed is maintained which allows for withdrawal of syn-coal as a clean by-product for further downstream production in a syn-coal conglomeration unit 108. Moreover, syn-coal is withdrawn from the third reaction zone 26 for recycling back into the inner reaction zone 22. In the upper lime treating zone 28, contaminate $H_2S$ gas is converted into a useful and manageable by-product CaS 70 which may be easily removed from the system.

Gasification support reactor vessels include a recycle syn-coal heating vessel 40 and a limestone calcinator vessel 36. In the recycle syn-coal heating vessel 40, the syn-coal from reaction zone 26, withdrawn through line 46, is superheated through air burning of a portion of the carbon on the recycle syn-coal and re-introduced into the first reaction zone 22 thereby providing increased reaction heat. Moreover, contaminate reaction gases $N_2$ and $CO_2$ are easily and safely removed from the top of the rector vessel 40 thereby avoiding contamination of the product gas 84. In the limestone calcinator vessel 36, the necessary process air 32 is superheated and delivered, via line 38, to the inner reaction zone 22. Compressed air 64 and syn-coal 62 is injected into the reaction vessel 36 to simultaneously calcine limestone whereby lime and ash are formed as by-products and the hot air and $CO_2$ gas are diverted out of the top of the vessel 36. The process and system of the present invention provides for further process flexibility by allowing the syn-coal 62 to be withdrawn from the third reaction zone 26 for direct use or diverted to a syn-coal conglomeration unit 108 for producing lump coke 120 to be used in steel blast furnace operations.

The quality of the feed stocks discussed above can vary over a broad range, but the high quality of the products obtained from the feed stocks more than meets the desired specifications and the process is environmentally attractive.

The instant gasification process and system can also be used advantageously to reduce iron oxide ores to iron carbide or to pure iron. $H_2$ and CO can be produced efficiently as by-products of the instant gasification process and system.

In describing the invention, reference has been made to preferred embodiments and illustrative advantages of the invention. Those skilled in the art, however, and familiar with the instant disclosure of the subject invention, may recognize additions, deletions, modifications, substitutions and other changes which fall within the purview of the subject invention.

What is claimed:

1. A catalytic gasification process for the production of a medium grade BTU gas comprising the steps of:

providing a catalytic reagent comprising a process reagent and an alkali metal in a gasification reaction vessel, said process reagent selected from the group consisting of sillimanite and mullite;

delivering carbonaceous fuel to the reaction vessel;

delivering hot air to the reaction vessel;

delivering steam to the reaction vessel; and withdrawing a medium grade BTU gas having direct commercial utility from the reaction vessel.

2. A gasification process as defined in claim 1 further comprising the steps of:

providing a first, second, third, and fourth reaction zone in the reaction vessel; and delivering the carbonaceous fuel to said first reaction zone, the heated air to said first reaction zone, and the steam to said second reaction zone;

such that oxygen of the air reacts with carbon of the carbonaceous fuel in an exothermic reaction creating a low grade BTU gas primarily consisting of carbon monoxide (CO) and nitrogen ($N_2$) gas, said hot air further causing deposition of the carbon of the carbonaceous fuel on the catalytic reagent and on product ash, thereby creating synthetic coal, whereby the synthetic coal and low grade BTU gas gravitate to the third reaction zone of the reaction vessel, and the catalytic reagent flows into the second reaction zone of said reaction vessel;

whereby carbon deposited on the catalytic reagent reacts with the oxygen in the steam in an endothermic reaction to create a high grade BTU gas consisting primarily of hydrogen ($H_2$) and carbon monoxide (CO) gas which flows into the third reaction zone of the reaction vessel to mix with the low grade BTU gas thereby forming a medium grade BTU gas.

3. A gasification process as defined in claim 2 further comprising the steps of:

withdrawing a portion of the synthetic coal from the third reaction zone and delivering the withdrawn synthetic coal to a synthetic coal heating vessel and, in turn, withdrawing a heated recycled synthetic coal from the synthetic coal heating vessel, and delivering the recycled synthetic coal to the first reaction zone of the reaction vessel thereby providing an increase in reaction heat whereby the rate of withdrawal is controlled depending on amount of process heat desired in the first reaction zone;

delivering air to the synthetic coal heating vessel in order to react the carbon of the synthetic coal in an exothermic reaction to primarily form carbon dioxide ($CO_2$) and nitrogen ($N_2$) product gas and withdrawing the product gas from the heating vessel; and withdrawing another portion of the synthetic coal from the third reaction zone of the reaction vessel as a clean by-product having commercial utility.

4. A gasification process as defined in claim 3 further comprising the steps of:

withdrawing hot recycled synthetic coal from the synthetic coal heating vessel;

delivering the withdrawn recycled synthetic coal to a second reaction vessel;

delivering steam to the second reaction vessel such that said steam reacts with the carbon of the synthetic coal in the second reaction vessel to produce a gas mixture comprising hydrogen ($H_2$) and carbon monoxide (CO); and withdrawing said gas mixture from said second reaction vessel.

5. A gasification process as defined in claim 1 further comprising the steps of:

delivering petroleum coke to the reaction vessel; and said step of delivering carbonaceous fuel comprises heating residual petroleum fuels and delivering said heated petroleum fuels to the reaction vessel.

6. A gasification process as defined in claim 1 further comprising the steps of:

delivering iron carbide to the reaction vessel; and removing iron from the reaction vessel.

7. A gasification process as defined in claim 1 wherein the step of delivering carbonaceous fuel comprises:

delivering a blended mixture of coal and the catalytic reagent to the reaction vessel.

8. A gasification process as defined in claim 1 further comprising the steps of:

delivering lime (CaO) to the reaction vessel such that the lime reacts with a contaminant gas ($H_2S$) to produce a clean product (CaS) which gravitates to an upper portion of the reaction vessel;

withdrawing the CaS product from the upper portion of the reaction vessel as a clean by-product;

withdrawing limestone ($CaCO_3$) from the reaction vessel;

delivering the limestone ($CaCO_3$) withdrawn from the reaction vessel to a limestone calcinator vessel;

withdrawing a synthetic coal product from the reaction vessel and delivering the synthetic coal to the limestone calcinator vessel;

delivering air to the limestone calcinator such that the oxygen content of the air reacts with carbon of the synthetic coal in an exothermic reaction to form a hot carbon dioxide ($CO_2$) and air product;

withdrawing the hot carbon dioxide ($CO_2$) and air product and delivering the product to the reaction vessel as the hot air delivered thereto;

withdrawing a lime (CaO) by-product from the calcinator vessel and delivering the lime by-product to the reaction vessel;

withdrawing an ash by-product from the lime calcinator vessel;

withdrawing a portion of the catalytic reagent from the reaction vessel and recycling the withdrawn catalytic reagent back to a mixing device for blending with carbonaceous fuel for delivery to the reaction vessel; and withdrawing heavy metal contaminants through a lower portion of the reaction vessel for safe removal.

9. A gasification process as defined in claim 1 wherein:

the carbonaceous fuel is coal.

10. A gasification process as defined in claim 1 wherein:

the process reagent is sillimanite ($Al_2O_3.SiO_2$) and the alkali metal is selected from the group consisting of sodium (Na) and potassium (K).

11. A gasification process as defined in claim 10 wherein:

the sillimanite ($Al_2O_3.SiO_2$) process reagent is chemically bonded with sodium (Na) to form the catalytic reagent $Al_2O_3.SiO_2.Na_2O$.

12. A gasification process as defined in claim 10 wherein:

the sillimanite ($Al_2O_3.SiO_2$) process reagent is chemically bonded with potassium (K) to form the catalytic reagent $Al_2O_3.SiO_2.K_2O$.

13. A gasification process as defined in claim 1 wherein:

the catalytic reagent comprises 75% wt. sillimanite and 25% wt. alkali metal.

14. A gasification process as defined in claim 1 wherein:

the process reagent is mullite ($3Al_2O_3.2SiO_2$) chemically bonded with the alkali metal in order to form the catalytic reagent.

15. A gasification process as defined in claim 1 wherein:

the reactions occurring in the reaction vessel are conducted at a pressure in the range of 150 to 200 p.s.i.g.

16. A gasification process as defined in claim 1 wherein:

the reactions occurring in the reaction vessel provide a vessel temperature profile in the range of 850°–1700° F.

17. A catalytic gasification process for the production of a medium grade BTU gas comprising the steps of:

providing a catalytic reagent comprising a process reagent and an alkali metal in a gas reaction vessel, said process reagent selected from the group consisting of sillimanite and mullite;

delivering carbonaceous fuel to a first reaction zone of said reaction vessel;

delivering hot air to said first reaction zone of said reaction vessel;

delivering preheated iron oxides to a second reaction zone of said reaction vessel; and withdrawing a medium grade BTU gas from the reaction vessel;

whereby hot air delivered to said first reaction zone reacts with carbon of the fuel in an exothermic reaction for the production of a low grade BTU gas and preheated iron oxides delivered to said second reaction zone react with carbon deposited on said catalytic reagent in an endothermic reaction for the production of a high grade BTU gas wherein the low grade BTU gas and the high grade BTU gas mix thereby forming a medium grade BTU gas.

18. A gasification process as defined in claim 17 further comprising the steps of:

removing iron carbide from the reaction vessel; and storing iron oxides in a storage vessel for delivery to the reaction vessel;

delivering medium grade BTU gas to the storage vessel;

removing the BTU gas from the storage vessel.

19. A gasification system for the production of a medium grade BTU gas comprising:

a gas reaction vessel which contains a catalytic reagent comprising a process reagent and an alkali metal, said process reagent selected from the group consisting of sillimanite and mullite;

a first inlet means for receiving and directing carbonaceous fuel to said reaction vessel;

a second inlet means for receiving and directing heated air to said reaction vessel;

a third inlet means for receiving and directing steam to said reaction vessel;

a gas product outlet means for removing a medium grade BTU gas from the reaction vessel; and a conveyance means for delivering carbonaceous fuel through said first inlet means.

20. A gasification system as defined in claim 19 wherein:

the gas reaction vessel comprises a first, second, third, and fourth reaction zone;

the first and second reaction zones are located in a lower portion of the reaction vessel, the fourth reaction zone is located at an upper portion of the reaction vessel, and the third reaction zone is located therebetween; and the first inlet means delivers carbonaceous fuel to said first reaction zone, the second inlet means delivers heated air to said first reaction zone, and the third inlet means delivers steam to the second reaction zone;

whereby hot air delivered to said first reaction zone through said second inlet means reacts with carbon of the fuel in an exothermic reaction for the production of a low grade BTU gas and steam delivered to said second reaction zone through said third inlet means reacts with carbon deposited on said catalytic reagent in an endothermic reaction for the production of a high grade BTU gas wherein the low grade BTU gas and the high grade BTU gas mix in the third reaction zone thereby forming a medium grade BTU gas.

21. A gasification system as defined in claim 20 further comprising:

a first and second outlet means for removing synthetic coal product from the third reaction zone of the reaction vessel such that synthetic coal is removed from the third reaction zone through said first outlet means as a clean by-product having direct commercial use and synthetic coal is removed from the third reaction zone through said second outlet means for recycling back to the reaction vessel; and a synthetic coal heating vessel having an inlet means for receiving withdrawn synthetic coal from said second outlet means of said reaction vessel and an air inlet means for receiving air, said synthetic coal heating vessel further comprising a first outlet means for removing hot recycled synthetic coal from the heating vessel for delivery to a fourth inlet means of said reaction vessel which receives and directs the hot synthetic coal to the first reaction zone of the reaction vessel; and a second outlet means for removing contaminant product gases from the heating vessel.

22. A gasification system as defined in claim 21 wherein:

the synthetic coal heating vessel further comprises a third outlet means for removing hot recycled synthetic coal from the heating vessel; and the gasification system further comprises a second gas reaction vessel having a first inlet means for receiving and directing hot recycled synthetic coal, withdrawn through said third outlet means of the heating vessel, to said second reaction vessel; a second inlet means for receiving and directing steam to said second reaction vessel; and a gas product outlet means for removing a gas mixture comprising hydrogen ($H_2$) and carbon monoxide (CO) from the second reaction vessel.

23. A gasification system as defined in claim 20 further comprising:

a fourth inlet means for receiving and directing petroleum coke to the third reaction zone of said reaction vessel; and the conveyance means includes means for storing petroleum coke; means for heating and storing residual petroleum fuels; and means for delivering petroleum coke through said fourth inlet means and means for delivering said residual petroleum fuels through said first inlet means.

24. A gasification system as defined in claim 20 further comprising:

a fourth inlet means for receiving and directing iron carbide to the third reaction zone of said reaction vessel;

an iron outlet means for removing iron from the reaction vessel; and an iron conveyance means including means for storing iron carbide and means for delivering iron carbide through said fourth inlet means.

25. A gasification system as defined in claim 20 wherein:

said conveyance means includes means for storing a blended mixture of coal and the catalytic reagent; and means for delivering the blended mixture through said first inlet means.

26. A gasification system as defined in claim 20 further comprising:

a fourth inlet means for receiving and directing lime (CaO) into said reaction vessel whereby the lime reacts with a contaminant sulfur gas ($H_2S$) to produce a clean calcium sulfide (CaS) product;

a second outlet means for removing calcium sulfide (CaS) product from the reaction vessel for delivery to a storage facility;

a third outlet means for removing a limestone ($CaCO_3$) by-product from the reaction vessel;

a hot air production vessel having an inlet for receiving and directing limestone ($CaCO_3$) by-product, withdrawn through the third outlet means of the reaction vessel, to the hot air production vessel;

a synthetic coal inlet for receiving and directing synthetic coal product, withdrawn from a synthetic coal outlet means of the reaction vessel, to the hot air production vessel;

an air inlet means for receiving and directing air to the hot air production vessel;

whereby carbon of the synthetic coal reacts with the air in an exothermic reaction to create a hot $CO_2$ and air gas product which is then diverted out an outlet of the hot air production vessel for delivery to the reaction vessel;

a lime outlet means for removing lime (CaO) as a reaction by-product from the hot air production vessel for delivery to the reaction vessel through the fourth inlet; and an ash outlet means for removing an ash by-product from the hot air production vessel.

27. A gasification system as defined in claim 20 wherein:

a process partition separates the third and fourth reaction zones;

a sleeve separates the first and second reaction zones such that the first reaction zone is contained within the sleeve and the second reaction zone is contained in a circumferential volume bound by the reaction vessel wall and the sleeve;

the reaction vessel is cylindrical in form and the sleeve is cylindrical in form thereby creating an annular second reaction zone;

the third steam inlet means of the reaction vessel comprises a plurality of inlets peripherally spaced about the reaction vessel;

a second outlet means located at a lower portion of the reaction vessel for removing catalytic reagent for recycling;

a third outlet means located at a lower most portion of the reaction vessel for removing contaminant metal by-products for delivery to a safe storage facility; and a fourth inlet means located at a lower portion of the reaction vessel for receiving and directing $CO_2$ gas to the reaction vessel.

28. A gasification system as defined in claim 19 further comprising:

a synthetic coal conglomeration unit including, a vessel having an inlet means for receiving and directing a synthetic coal by-product to the vessel and an air inlet means for receiving and directing air to the vessel, and an outlet means for removing lump coke products from the vessel.

29. A gasification system for the production of a medium grade BTU gas comprising:

a gas reaction vessel which contains a catalytic reagent comprising a process reagent and an alkali metal, said process reagent selected from the group consisting of sillimanite and mullite;

a first inlet means for receiving and directing carbonaceous fuel to a first reaction zone of said reaction vessel;

a second inlet means for receiving and directing heated air to said first reaction zone of said reaction vessel;

a third inlet means for receiving and directing preheated iron oxides to a second reaction zone of said reaction vessel;

a gas product outlet means for removing a medium grade BTU gas from the reaction vessel; and a conveyance means for delivering carbonaceous fuel through said first inlet means;

whereby hot air delivered to said first reaction zone through said second inlet means reacts with carbon of the fuel in an exothermic reaction for the production of a low grade BTU gas and preheated iron oxides delivered to said second reaction zone through said third inlet means react with carbon deposited on said catalytic reagent in an endothermic reaction for the production of a high grade BTU gas wherein the low grade BTU gas and the high grade BTU gas mix thereby forming a medium grade BTU gas.

30. A gasification system as defined in claim 29 further comprising:

an iron carbide outlet means for removing iron carbide from the reaction vessel;

a means for storing iron oxides and a means for delivering iron oxides through said third inlet means of the reaction vessel; and a BTU gas inlet means for receiving and directing medium grade BTU gas to the means for storing iron oxides and a BTU gas outlet means for removing the BTU gas from the means for storing iron oxides.

* * * * *